United States Patent [19]

Rader

[11] 4,334,794

[45] Jun. 15, 1982

[54] SELF SHARPENING PENCILS

[75] Inventor: William W. Rader, Gates Mills, Ohio

[73] Assignees: Cal W. Hay, Gates Mills; Frederick Mann, Columbus, both of Ohio

[21] Appl. No.: 176,933

[22] Filed: Aug. 11, 1980

[51] Int. Cl.[3] ..... B43K 29/06

[52] U.S. Cl. ..... 401/50; 401/52

[58] Field of Search ..... 401/50, 51, 49, 82

[56] References Cited

U.S. PATENT DOCUMENTS

| | | | |
|---|---|---|---|
| 1,482,300 | 1/1924 | Hansen | 401/50 |
| 1,776,098 | 9/1930 | Barbas | 401/50 |
| 2,065,800 | 12/1936 | Freeman | 401/50 |
| 2,512,208 | 6/1950 | Kuper | 401/51 |
| 2,532,384 | 12/1950 | Worden | 401/50 |
| 2,680,426 | 6/1954 | Kobut | 401/51 |
| 2,997,983 | 8/1961 | Nock | 401/50 |
| 3,768,915 | 10/1973 | Spatz | 401/50 |
| 3,836,265 | 9/1974 | Kapilow | 401/82 |
| 3,967,905 | 7/1976 | Hsieh | 401/51 |

FOREIGN PATENT DOCUMENTS

| | | | |
|---|---|---|---|
| 231887 | 2/1959 | Australia | 401/50 |
| 347196 | 2/1905 | France | 401/50 |

*Primary Examiner*—William Pieprz

*Attorney, Agent, or Firm*—J. H. Slough

[57] ABSTRACT

The disclosure involves a self-sharpening pencil comprising a hollow housing having an integral self-contained non-rotatable fixed sharpener therein for a lead adapted to be linearly projected therethrough for filing the said lead by manually reciprocable lead carrier means.

The lead is adapted to be linearly guided by means located within the housing and a reservoir or collection chamber is provided for filings within said housing.

10 Claims, 15 Drawing Figures

SELF SHARPENING PENCILS

This invention relates to self-contained, self-sharpening disposable writing instruments of the pencil type.

In the past, various type self-sharpening pencils have been proposed, among those U.S. Pat. No. 823,705 which discloses a pencil with a removable head which can be removably positioned within a slot having an abrading surface such as sandpaper wrapped thereon, and selectively employed to sharpen the lead; U.S. Pat. No. 1,012,765 which disclosed nested conical members surrounding the lead and having abrading materials such as sandpaper lining the same which can be manually pinched and worked about the end of the lead to sharpen said end thereof; a U.S. Pat. No. to Housen, i.e. 1,482,300 which discloses a self-feeding and self-sharpening pencil comprising a metal barrel for the pencil having a tip of conical form at the lead feeding end, which is provided with inwardly extending projections with cutting points thereon for digging into the pencil or sharpening the same; U.S. Pat. No. 2,532,384 to Worden which shows a detachable sharpener adapted to be telescoped over a mechanical pencil; similarly U.S. Pat. No. 3,288,113 which discloses a conical sleeve carried by an end piece having cutting blades inclined at an angle, the lead being pressed against the blades when the tip is pulled away from the pencil case; also, U.S. Pat. No. 1,327,038 which discloses a sharpener which can be adjusted to one side of the barrel of the pencil to present only a relatively small portion of the lead at a time to the sharpener.

I am further acquainted with a prior art device which includes an abrasive sharpener within a pencil housing, the said sharpener being movable from a storage to a sharpening position as desired in response to retraction of the lead. The said pencil is indexed to automatically rotate the lead to present different sections of the lead to the sharpener during each stroke.

My invention consists in the provision of a sharpening device within a hollow housing for a lead pencil which sharpener is maintained at all times in a fixed position within the housing and is non-rotating.

It is an object of my invention to provide a disposable pencil which is self-sharpening, simple in construction, being of few parts, inexpensive to manufacture and highly efficient in use.

It is a further object of my invention to provide in a pencil of the type described, a sharpener which will quickly and expeditiously sharpen all surfaces of the projecting tip of a lead adapted to be projected out of the tip of the pencil casing by a mere linear back and forth movement of the lead.

A still further object of my invention is to automatically subject successive portions of the lead to the said sharpening process as the tip is worn off in use so that the lead may be resharpened numerous times.

Another object of my invention is to provide in a mechanical pencil of the type described a collection chamber or reservoir for fillings removed from the lead in the sharpening process which will not interfere with the said process.

Other objects of my invention and the invention itself will become more readily apparent by reference to the following specification and drawings, in which drawings.

Figure 1:
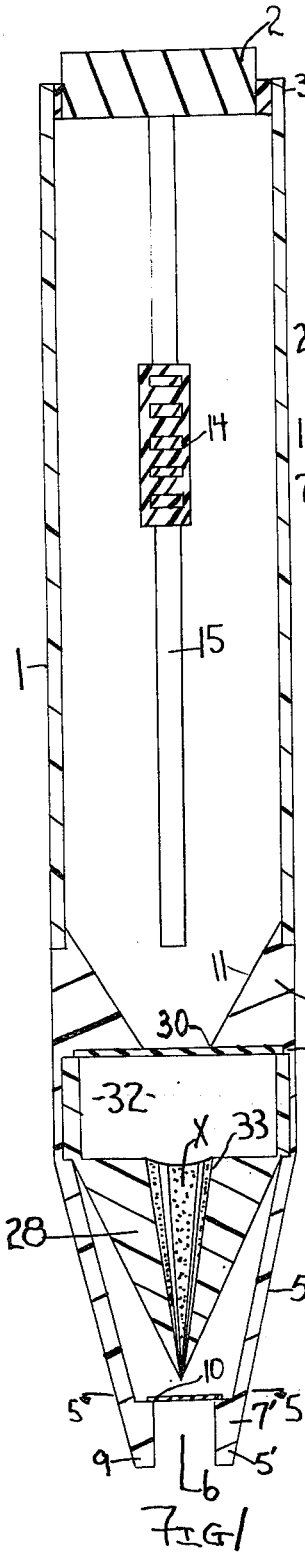
FIG. 1 is a longitudinal sectional view through the improved pencil of my invention, disclosing the lead's extension therethrough.
Figure 2:
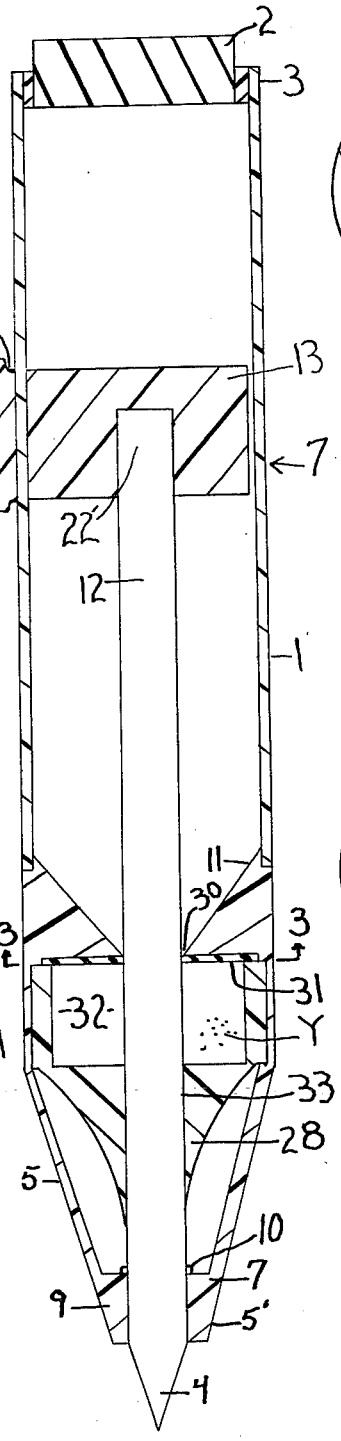
FIG. 2 is a view of the invention similar to FIG. 1 but disclosing the lead within the pencil casing and the sharpener in non-operative relation thereto.
Figure 3:
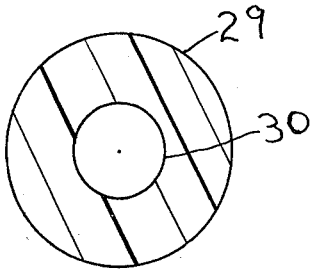
FIG. 3 is an enlarged top plan view taken along the line 3—3 of FIG. 2.
Figure 4:
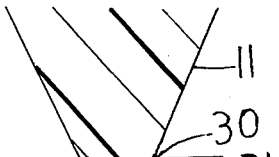
FIG. 4 is an enlarged elevational view of the upper lead guide of FIG. 2.
Figure 5:
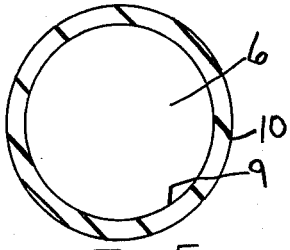
FIG. 5 is an enlarged top plan view taken along the line 5—5 of FIG. 2.
Figure 6:
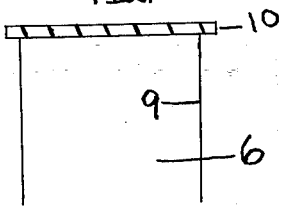
FIG. 6 is an enlarged view of the end guide of FIG. 2.

Referring now to the drawings, in all of which like parts are designated by like reference characters in FIGS. 1 and 2, at 1, I show a barrel or casing open at both ends, provided with an eraser 2 at one end 3 and a lead point 4 at the outer end 5. The barrel 1 is preferably elongated and of generally cylindrical or tubular configuration of substantially uniform wall thickness throughout its length, and is formed preferably of plastic or plastic components or metal or other desired material. The tip or outer portion 5 is preferably provided with tapered conical end 5' through which the lead is fed and the tip bore 6 is substantially the size of the diameter of the lead passing therethrough.

The lead is retained in the barrel by lead supports or guides, diaphragms or disc partitions 7; one is preferably disposed at the outer tip end as shown at 7' and consists of an open ended ring or tapered annulus 9 integrally formed in the wall of the casing and annular gasket means 10 adapted to be snugly fitted within the barrel tip end and one spaced therefrom but adjacent the discharge end provided by inwardly tapering the inner walls of the barrel as shown at 11 to form a V-shaped lead contact means.

Figure 8:
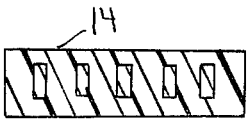
FIG. 8 is an enlarged top view of the thumb slide of FIG. 2.
Figure 7:
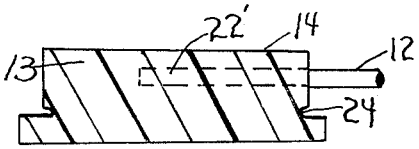
FIG. 7 is an enlarged elevational view of the thumb slide and the advance and retract means taken along the line 7—7 of FIG. 2, the view being rotated 90°.
Figure 14:
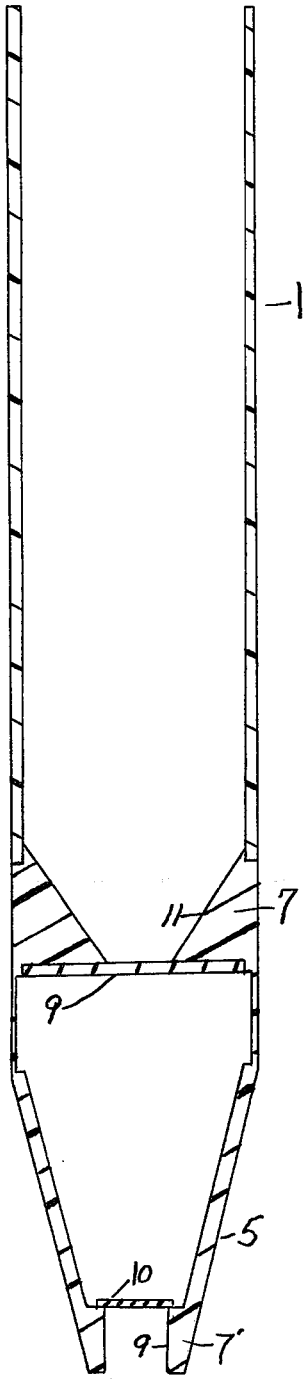
FIG. 14 is a sectional view of the pencil casing of my invention.
Figure 15:
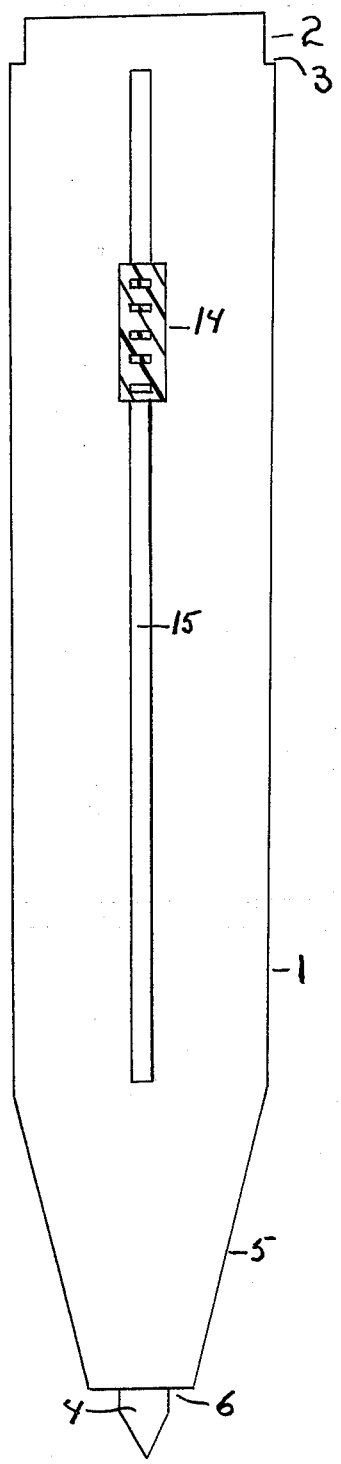
FIG. 15 is an elevational view of the casing showing the thumb slide and slot in which it rides.

As shown in FIG. 2, the innermost end of the lead 12 is tightly encased at its rear end in a bore 22' sized to snugly fit the same in a sleeve 13, which sleeve is preferably integrally formed with a connecting portion 24 and a serrated thumb slide 14, as shown in FIG. 8; the connecting portion is projected outwardly through an elongated slot 15 in the casing or barrel, as best shown in FIG. 1, which preferably extends substantially to the end of the casing or barrel which may be, as shown, closed by the eraser 2 or a cap, not shown, to permit the insertion, if desired, of other leads. The lead is thus adapted to have linear longitudinal movement in and through the barrel in response to manual sliding movement of the said thumb guide.

At the apex end of the V-shaped lead guide 7 formed by the inwardly tapered inner walls of the casing or barrel, an opening 30 is provided for the lead to pass through and provides as well a circular disc 29 seating a gasket 31 which forms the upper wall of a reservoir or compartment 32 which is adapted to receive filings from a sharpener associated with the pencil as hereinafter described.

As illustrated herein, the preferred embodiment of my invention comprises a sharpener 28 adapted to be integrally and non-rotatably fixedly secured within the tapered end 5 of the pencil holder and preferably is a multifaced exterior polygonal frustrom or pyramid having an elongated opening 33 of greater width at its inward end 33*a* and tapering to a minimum 33*b* adjacent but spaced from the apex or outward end of the barrel. Said sharpener is preferably integrally formed in the casing and is provided on its inner sides with an abrasive surface such as sandpaper, emery or abrasive particles as shown at "X" to form abrading tapered surfaces adapted to shear or shave portions of the circular lead as the end thereof is projected therethrough or from the tip opening by the advance and retract mechanism, i.e. the thumb slide and connected sleeve means. Hence, by mere linear translocation, the successive outer surfaces of the ends of the lead, which is carried by the movable sleeve and guided by the lead guides through the barrel, are linearly frictionally engaged with the tapered abrasive walls of the sharpener as they pass through the same and are sharpened thereby. The filings "Y" are adapted to be deposited in the reservoir 32 as shown in FIG. 2 as these are removed.

It will be noted that FIGS. 1 and 2 are fragmented oversize views of the self-sharpening pencil of my invention and that the sharpener is in reality only spaced slightly above the end guide for the lead and that the said end guide may be formed in any preferred manner as by forming and molding a guide in such end and/or by using a resilient tapered apertured fitting therein.

Figures 11, 12, 13:
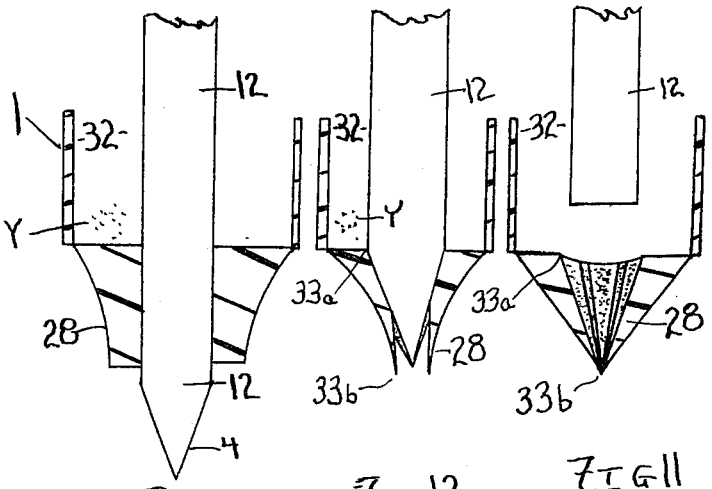
FIGS. 11, 12 and 13 are views of the sharpener and lead passing therethrough in different operative positions.
Figure 10:
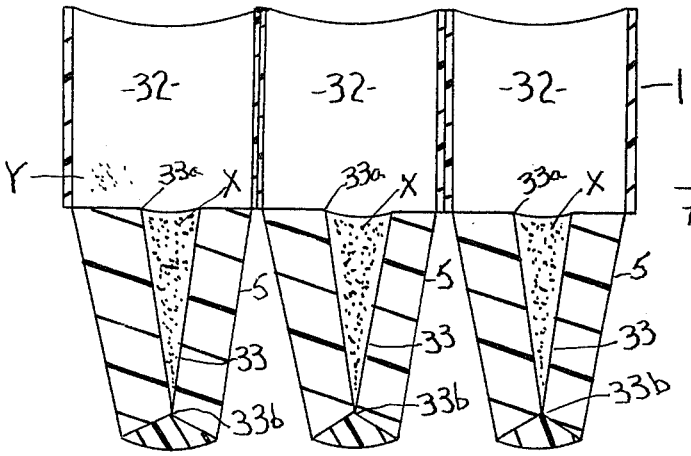
FIG. 10 is an exploded view of the sharpener of FIGS. 1 and 2.
Figure 9:
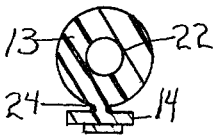
FIG. 9 is an enlarged top end view of the thumb slide and advance and retract means of FIG. 7.

It will also be noted that the tapered opening in the sharpener permits, as shown in FIGS. 11, 12 and 13 the end of the sharpener to open to an extent to permit not only passage of the lead out of the casing but also to exert a slight compressive action thereon when the sharpened pencil is in use.

The self-sharpening pencil of this invention is adapted to be formed of relatively inexpensive material, is inexpensive to manufacture, and is disposable in the manner of stick ball pens having limited use.

While I have described my invention in connection with a preferred embodiment hereof, it is to be understood that numerous and extensive departures could be made therefrom, without however, departing from the spirit of the invention and the scope of the appended claims.

What I claim is:

1. In a self-sharpening pencil, a tubular casing having an elongated slot in said casing, at least one lead guide, positioned within said casing, advance and retract means comprising a manually operable slide, a lead carrier secured to said slide and disposed within said casing, the extent of linear movement of the advance and retract means carrying the lead being restricted by the ends of the slot in which the slide is adapted to advance or retract the said lead, a sharpener positioned in the tapered tip end of said casing, said sharpener having an abrasive member having inner, conically shaped abrasive surfaces, the said lead being adapted to be linearly translocated through the sharpener and in contact with said surfaces during movement of the slide to simultaneously file all surfaces of the outer end of said lead, a reservoir provided in the casing between the lead guide and the sharpener to accommodate filings from said lead.

2. A self-sharpening pencil as claimed in claim 1 wherein the casing is formed of plastic material.

3. A self-sharpening pencil as claimed in claim 1 wherein the sharpener is tapered and provided with an elongated slot throughout the length thereof, said slot tapering inwardly toward the outer lead exit end of the casing.

4. A self-sharpening pencil as claimed in claim 1 wherein the sharpener is fixed in the casing and non-rotatable with respect thereto.

5. A self sharpening pencil as claimed in claim 1 wherein the lead is secured at its inner end within the lead carrier and guided in its movement through the casing by at least one lead support integrally secured to the inner walls of the casing, which lead support is spaced from the sharpener and guides the lead axially therethrough, outer portions of the lead being sheared away by the sharpener producing a sharpened tip on the lead.

6. A self sharpening pencil as claimed in claims 1 and 5 wherein the sharpening of the lead may be effected by either advancing or retracting the lead through the sharpener within the casing.

7. A self sharpening pencil as claimed in claim 1 in which the said lead guide is integrally formed in the said casing.

8. A self sharpening pencil as claimed in claim 1 in which the said lead carrier is integrally secured to said slide.

9. A self sharpening pencil as claimed in claim 1 in which said sharpener is integrally formed in the tapered tip end of said casing.

10. A self-sharpening pencil as claimed in claim 3 in which said slot extends substantially to the end of the casing.

* * * * *